US012674292B2

(12) United States Patent
Won et al.

(10) Patent No.: US 12,674,292 B2
(45) Date of Patent: Jul. 7, 2026

(54) CIVIL ENGINEERING CIVIL FIBER TUBE STRUCTURE AND CIVIL ENGINEERING CIVIL FIBER TUBE STRUCTURE CONNECTION CONSTRUCTION METHOD

(71) Applicant: Industry-Academic Cooperation Foundation, Kunsan National University, Gunsan-si (KR)

(72) Inventors: Myoung Soo Won, Gunsan-si (KR); Hyeong Joo Kim, Gunsan-si (KR)

(73) Assignee: Industry-Academic Cooperation Foundation, Kunsan National University, Gunsan-si (KR)

( * ) Notice: Subject to any disclaimer, the term of this patent is extended or adjusted under 35 U.S.C. 154(b) by 106 days.

(21) Appl. No.: 18/754,175

(22) Filed: Jun. 26, 2024

(65) Prior Publication Data

US 2025/0297441 A1 Sep. 25, 2025

(30) Foreign Application Priority Data

Mar. 22, 2024 (KR) ..... 10-2024-0039765

(51) Int. Cl.

| | |
|---|---|
| ***E02B 3/10*** | (2006.01) |
| ***E02B 3/12*** | (2006.01) |
| ***E02B 7/00*** | (2006.01) |

(52) U.S. Cl.

CPC ..... *E02B 3/108* (2013.01); *E02B 3/127* (2013.01); *E02B 7/005* (2013.01)

(58) Field of Classification Search

CPC ..... E02B 3/108; E02B 3/127; E02B 7/005; E02B 17/202; E02B 17/205; E02D 17/202; E02D 17/205

See application file for complete search history.

(56) References Cited

U.S. PATENT DOCUMENTS

| | | | | |
|---|---|---|---|---|
| 4,184,788 A * | 1/1980 | Colle | E02B 3/127 405/18 |
| 6,200,067 B1 * | 3/2001 | Pena | E02B 3/108 405/91 |
| 6,715,960 B2 * | 4/2004 | Metz | E02B 3/108 405/116 |
| 7,891,914 B2 * | 2/2011 | Smallwood | E02B 3/127 383/117 |
| 8,777,523 B2 * | 7/2014 | Stephens | E02B 3/127 405/16 |
| 10,889,950 B2 * | 1/2021 | Philipsen | E02B 3/108 |

(Continued)

FOREIGN PATENT DOCUMENTS

| | | | |
|---|---|---|---|
| KR | 100778321 B1 * | 11/2007 | E02B 3/10 |
| KR | 101065272 B1 * | 9/2011 | |
| KR | 101326775 B1 * | 11/2013 | |

(Continued)

*Primary Examiner* — Frederick L Lagman

(74) *Attorney, Agent, or Firm* — Park, Kim & Suh, LLC

(57) ABSTRACT

The present disclosure provides a civil engineering civil fiber tube structure that includes: a tube body part made of a flexible civil fiber material, initially having a rectangular shape, and is rolled in a drum shape such that a lower coupling portion is formed at a lower center portion by coupling both ends in a longitudinal direction; and one or more injection taps disposed on a top in the longitudinal direction of the tube body part when the lower coupling portion is disposed at a lower center.

12 Claims, 21 Drawing Sheets

(56) References Cited

U.S. PATENT DOCUMENTS

| | | | | |
|---|---|---|---|---|
| 2009/0169301 | A1* | 7/2009 | Kim | E02B 3/14 405/15 |
| 2011/0229275 | A1* | 9/2011 | Winings | E02D 17/20 405/302.6 |

FOREIGN PATENT DOCUMENTS

| | | | | |
|---|---|---|---|---|
| KR | 10-1577609 | B1 | 12/2015 | |
| KR | 101754778 | B1 * | 7/2017 | E02B 3/18 |
| KR | 20210039829 | A * | 4/2021 | E02B 3/127 |

* cited by examiner

CIVIL ENGINEERING CIVIL FIBER TUBE STRUCTURE AND CIVIL ENGINEERING CIVIL FIBER TUBE STRUCTURE CONNECTION CONSTRUCTION METHOD

CROSS REFERENCE TO RELATED APPLICATION

The present application claims priority to Korean Patent Applications No. 10-2024-0039765, filed Mar. 22, 2024, the entire contents of which are incorporated herein for all purposes by this reference.

BACKGROUND

Technical Field

The present disclosure relates to simple reclamation that is applied to reclaimed and eroded lands. In more detail, the present disclosure relates to a civil engineering civil fiber tube structure that increases structural durability and has a generally easy assembly state after construction, and a civil engineering civil fiber tube structure connection construction method.

Description of the Related Art

In general, a land reclamation project is performed in a way of installing a seawall at a seashore, etc. and then filing up the sea between the seawall and the coastline. Further, recently, a technology of constructing a temporal seawall using a tube structure that is a temporal structure, and then performing the work of reclamation or constructing a breakwater is proposed.

FIG. 1 is a view schematically showing a process of manufacturing a tube body part of a civil engineering civil fiber tube structure according to the related art and FIG. 2 is a perspective view showing a manufactured state of a tube body part of a civil engineering civil fiber tube structure according to an embodiment of the present disclosure.

As shown in the figures, a civil engineering civil fiber tube structure according to the related art includes a tube body part being open on both sides and configured such that an accommodation portion is formed, and an injection tap 20 making it possible to inject dredged soil, etc. into the tube body part 1 is disposed on the top of the tube body part 1.

The ends of both sides of the tube body part 1 are closed using a sewing thread or separate end closing members.

Meanwhile, the tube body part 1 is formed by circumferentially combining a plurality of unit tube members 111, 112, and 113. In this case, the unit tube members 111, 112, and 113 are not limited to three shown in the figures, and may be composed of two unit tube members or four or more unit tube members.

One unit tube member of the plurality of unit tube members 111, 112, and 113 and an adjacent unit tube member overlap each other partially at an end and the overlap portions are coupled by a plurality of sewing threads longitudinally in the longitudinal direction of the tube structure.

Further, as shown in the figures, a reinforcing member 50 coupled across lengthwise the plurality of unit tube members 111, 112, and 113 is further provided.

A plurality of reinforcing members 50 may be installed at predetermined gaps along the transverse direction of the unit tube members 111, 112, and 113.

Further, the reinforcing member 50 is also coupled lengthwise to the plurality of unit tube members 111, 112, and 113 by a sewing thread and a plurality of reinforcing members may be applied.

The reinforcing member 50 is disposed lengthwise on the unit tube members 111, 112, and 113 in a completely close contact type, that is, in a surface contact state to more stably resist tension that is applied in the lengthwise direction using a friction force applied to the contact surface.

However, in the civil engineering civil fiber tube structure according to the related art described above, since the unit tube members 111, 112, and 113 are coupled in the longitudinal direction of the tube structure, there is a problem that when pressure acts inside and outside over time with the inside filled with dredged soil, the joints of the unit tube members 111, 112, and 113 are frequently opened.

In particular, there is a problem the sewing thread portions are easily damaged by expansion of inside dredged soil and their own weights at the joints between the unit tube members 111, 112, and 113 positioned at the lower portion.

PRIOR ART DOCUMENT

Patent Document

Korean Patent No. 10-1577609

SUMMARY

The present disclosure has been made in an effort to solve the problems in the related art described above and an objective of the present disclosure is to provide a civil engineering civil fiber tube structure that enables the coupling state of unit tubes to be stably maintained, and a civil engineering civil fiber tube structure connection construction method.

Further, an objective of the present disclosure is to provide a civil engineering civil fiber tube structure that can be generally efficiently assembled, and a civil engineering civil fiber tube structure connection construction method.

The objectives of an embodiment of the present disclosure are not limited to the objectives described above and other objectives will be clearly understood by those skilled in the art from the following description.

In order to achieve the objectives, the present disclosure provides a civil engineering civil fiber tube structure including: a tube body part made of a flexible civil fiber material, initially having a rectangular shape, and is rolled in a drum shape such that a lower coupling portion is formed at a lower center portion by coupling both ends in a longitudinal direction of the drum; and one or more injection taps disposed on a top in the longitudinal direction of the tube body part when the lower coupling portion is disposed at a lower center, wherein both open sides of the tube body part are closed by sewing threads, whereby coupling portions crossing the longitudinal direction of the tube body part are formed, and first connection coupling holes are formed with predetermined gaps in the longitudinal direction of the coupling portion.

In this configuration, the lower coupling portion may be formed such that bending margin portions are formed by bending preset regions, which are in contact with each other of both ends of the tube body part when the tube body part is bent in a drum shape from an initial state, to overlap each other, and the bending margin portions may be coupled by sewing threads in the longitudinal direction of the tube structure.

Further, the tube body part may be formed by coupling ends of adjacent unit tube members of a plurality of rectangular unit tube members in the longitudinal direction.

Further, the lower coupling portion may be formed by forming bending margin portions protruding outward with the same length in the longitudinal direction of the tube body part at partial regions of both ends of the tube body part and then coupling the bending margin portions with a sewing thread in an overlap state.

Further, the civil engineering civil fiber tube structure may further include a friction member between the bending margin portions.

Further, the civil engineering civil fiber tube structure may further include a pair of assistant coupling members disposed around an outer surface at both sides of the tube body part in a direction crossing the longitudinal direction of the tube body part, and second connection coupling holes may be formed with predetermined gaps in a longitudinal direction of the assistant coupling member.

Further, the civil engineering civil fiber tube structure may further include a reinforcing band member coupled to the tube body part by a sewing thread in the longitudinal direction of the tube body part.

Further, the civil engineering civil fiber tube structure may further include a transverse reinforcing member disposed in the tube body part across the inside of the tube body part in a direction crossing the longitudinal direction of the tube body part with both ends coupled to an inner side of the tube body part when the tube body part is formed in a drum shape.

Further, through-holes may be disposed with predetermined gaps in a longitudinal direction of a bridge.

Further, gap grooves may be disposed with preset gaps in a longitudinal direction at an end of the coupling portion.

Further, an end reinforcement unit having gap grooves formed with preset gaps in a longitudinal direction is installed in a pressed type at an end of the coupling portion.

The end reinforcement unit may include: an end reinforcement clip made of a metallic material and having a fitting portion formed at a first side to be pressed and fixed while covering an end of the coupling portion; and protrusions protruding with preset gaps at a second side of the end reinforcement clip, and the gap groove may be formed between the protrusions.

Further, the civil engineering civil fiber tube structure may further include: an assistant body part being open on both sides to be able to cover an outer side of the body part when the body part of the tube structure expands, and has a drum shape when expanding; and an assistant tube member including a plurality of third connection coupling holes disposed around the assistant body part at both sides of the assistant body part and an assistant injection tap provided so that dredged soil can be injected into the assistant body part.

Meanwhile, the present disclosure provides a civil engineering civil fiber tube structure connection construction method including: disposing the tube structures at both sides and then installing an assistant tube member to cover both of joints of the two tube structures; coupling second connection coupling holes of an assistant coupling member of a first tube structure and third connection coupling holes of the assistant tube member using cable ties; coupling portions of the first tube structure and a second tube structure; and coupling second connection coupling holes of an assistant coupling member of the second tube structure and third connection coupling holes of the assistant tube member using cable ties.

According to the civil engineering civil fiber tube structure and the civil engineering civil fiber tube structure connection construction method according to an embodiment of the present disclosure having the configurations described above, when a tube structure is filled with dredged soil, the lower coupling portion, which comes in contact with a marine ground, of the tube structure that has finished being filled is positioned at the center of the tube structure and the tube body part is pressed between the fed dredged soil and the marine ground, so the lower coupling portion is in a stably coupled state.

The objectives of an embodiment of the present disclosure are not limited to the objectives described above and other objectives will be clearly understood by those skilled in the art from the following description.

BRIEF DESCRIPTION OF THE DRAWINGS

The above and other objectives, features and other advantages of the present disclosure will be more clearly understood from the following detailed description when taken in conjunction with the accompanying drawings, in which.

DETAILED DESCRIPTION

Figure 1:
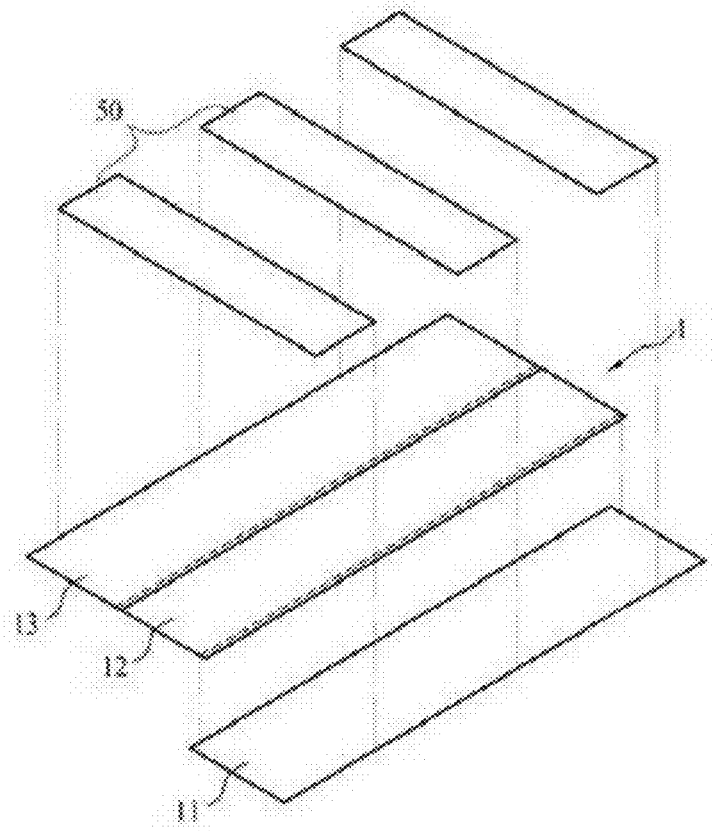
FIG. 1 Prior Art
FIG. 1 is a view schematically showing a process of manufacturing a tube body part of a civil engineering civil fiber tube structure according to the related art.
Figure 2:
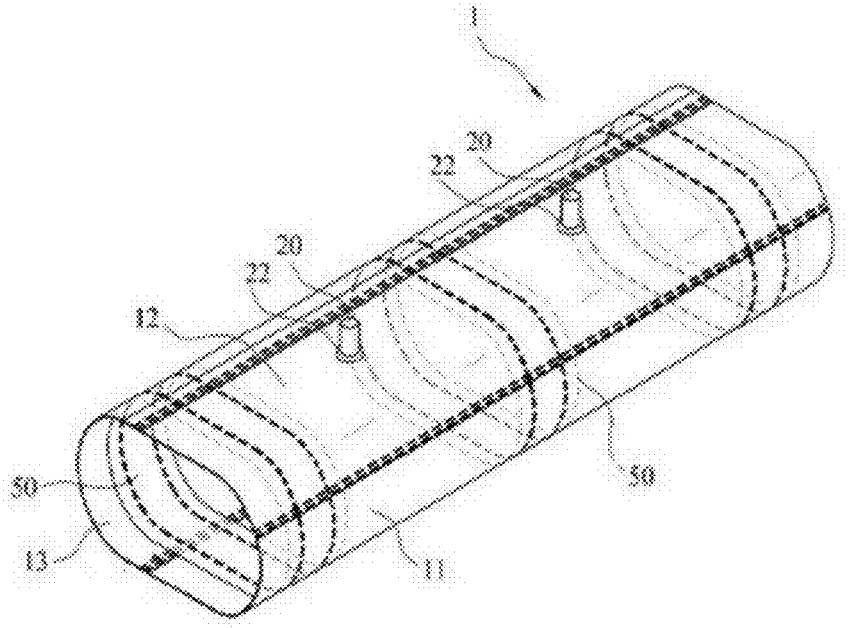
FIG. 2 is a perspective view showing a manufactured state of a tube body part of a civil engineering civil fiber tube structure according to an embodiment of the present disclosure.

Hereafter, a preferred embodiment of an embodiment of the present disclosure that can achieve the objectives of an embodiment of the present disclosure in detail is described with reference to the accompanying drawings. In the description of the embodiment, the same components are given the same names and reference numerals and are not repeatedly described.

Meanwhile, an embodiment of the present disclosure may be modified in various ways and implemented by various exemplary embodiments, so that specific exemplary embodiments are shown in the drawings and will be described in detail in the detailed description for implementing the present disclosure. However, it is to be understood that an embodiment of the present disclosure is not limited to the specific exemplary embodiments, but includes all modifications, equivalents, and substitutions included in the spirit and the scope of an embodiment of the present disclosure.

Further, terms used hereafter are used only in order to describe specific exemplary embodiments rather than limiting an embodiment of the present disclosure. Singular forms are intended to include plural forms unless the context clearly indicates otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Unless defined otherwise, it is to be understood that all the terms used in the specification including technical and scientific terms have the same meanings as those that are understood by those who skilled in the art. It will be further understood that terms such as terms defined in common dictionaries should be interpreted as having a meaning that is consistent with their meaning in the context of this specification and the relevant art and will not be interpreted in an idealized or overly formal sense unless expressly so defined herein.

Figure 3:
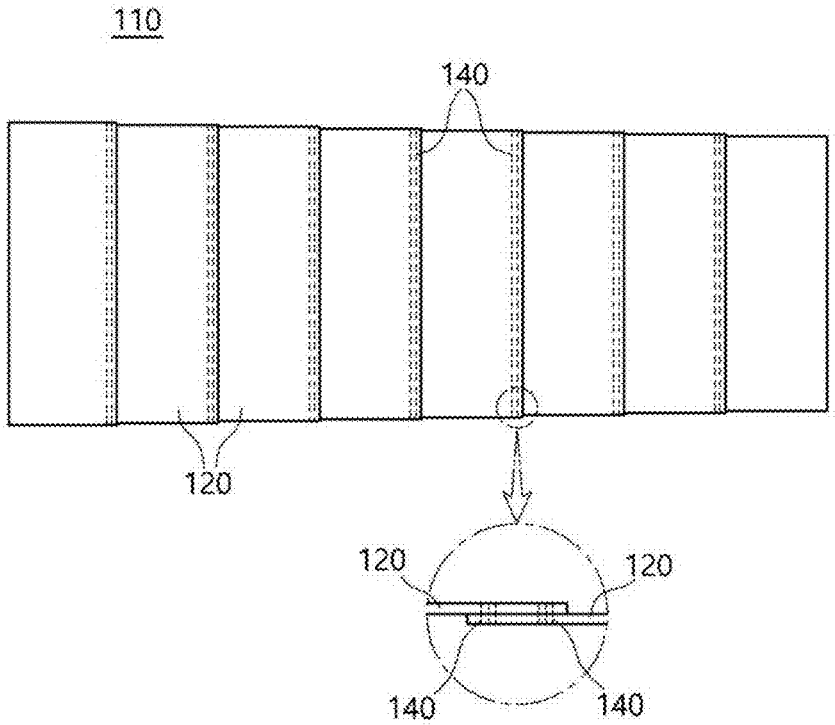
FIG. 3 is a view schematically showing an unfolded state of the tube body part in the civil engineering civil fiber tube structure according to an embodiment of the present disclosure.
Figure 4:
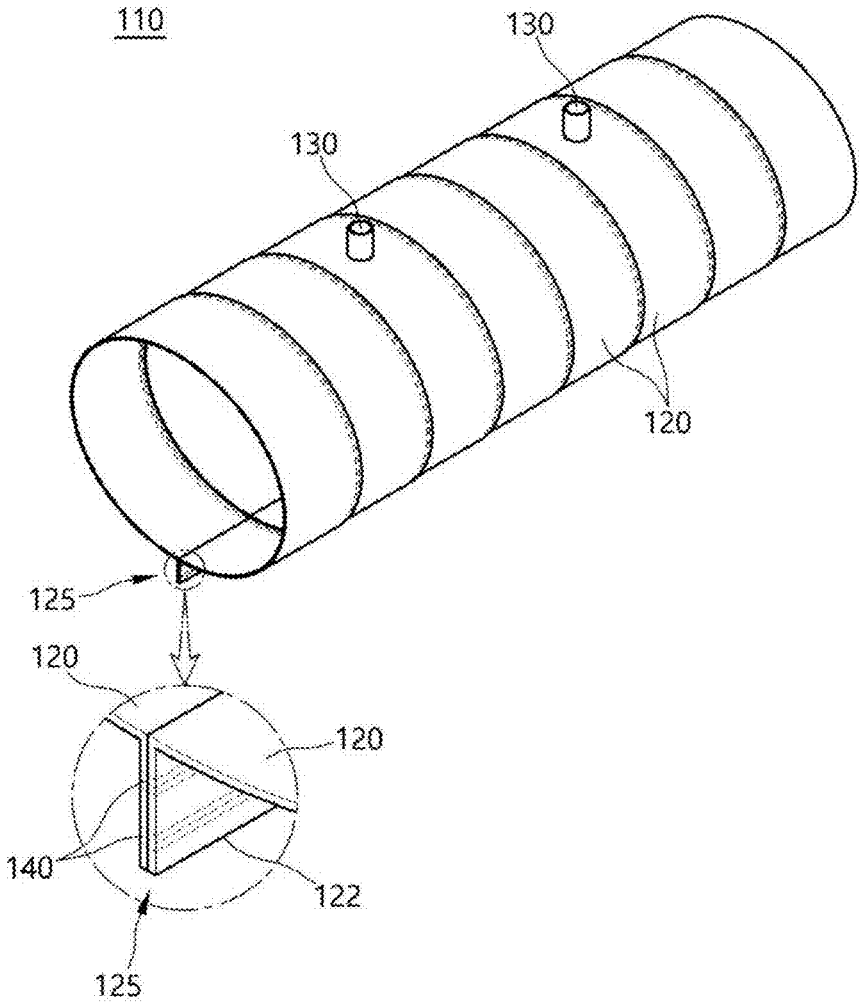
FIG. 4 is a perspective view showing a state in which a tube body part has been formed in a drum shape by coupling both ends of the tube body part shown in FIG. 3.
Figure 5:
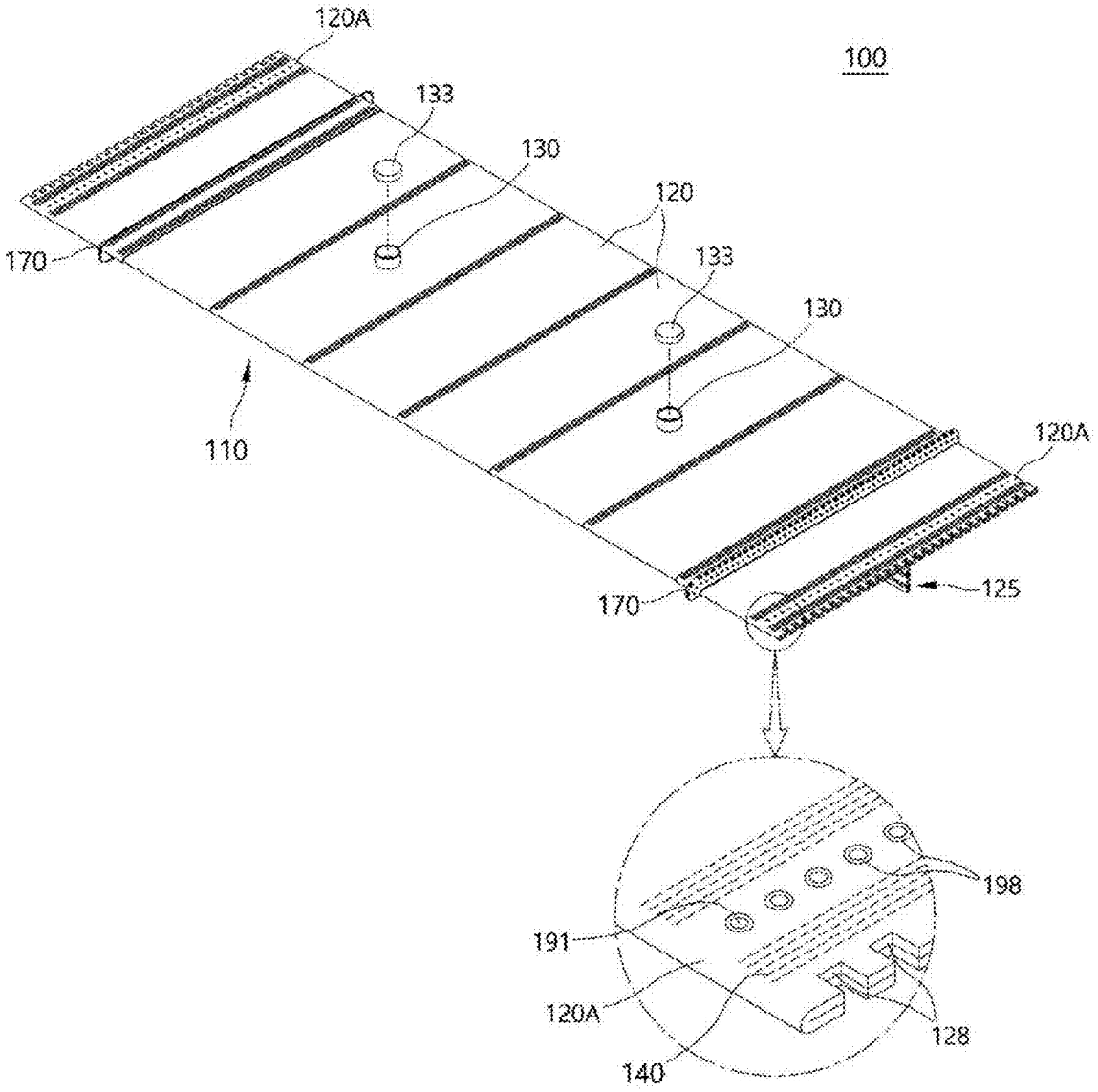
FIG. 5 is a perspective view showing the state in which a first side and a second side of the tube body part shown in FIG. 4 have been closed by forming coupling portions at the sides.
Figure 6:
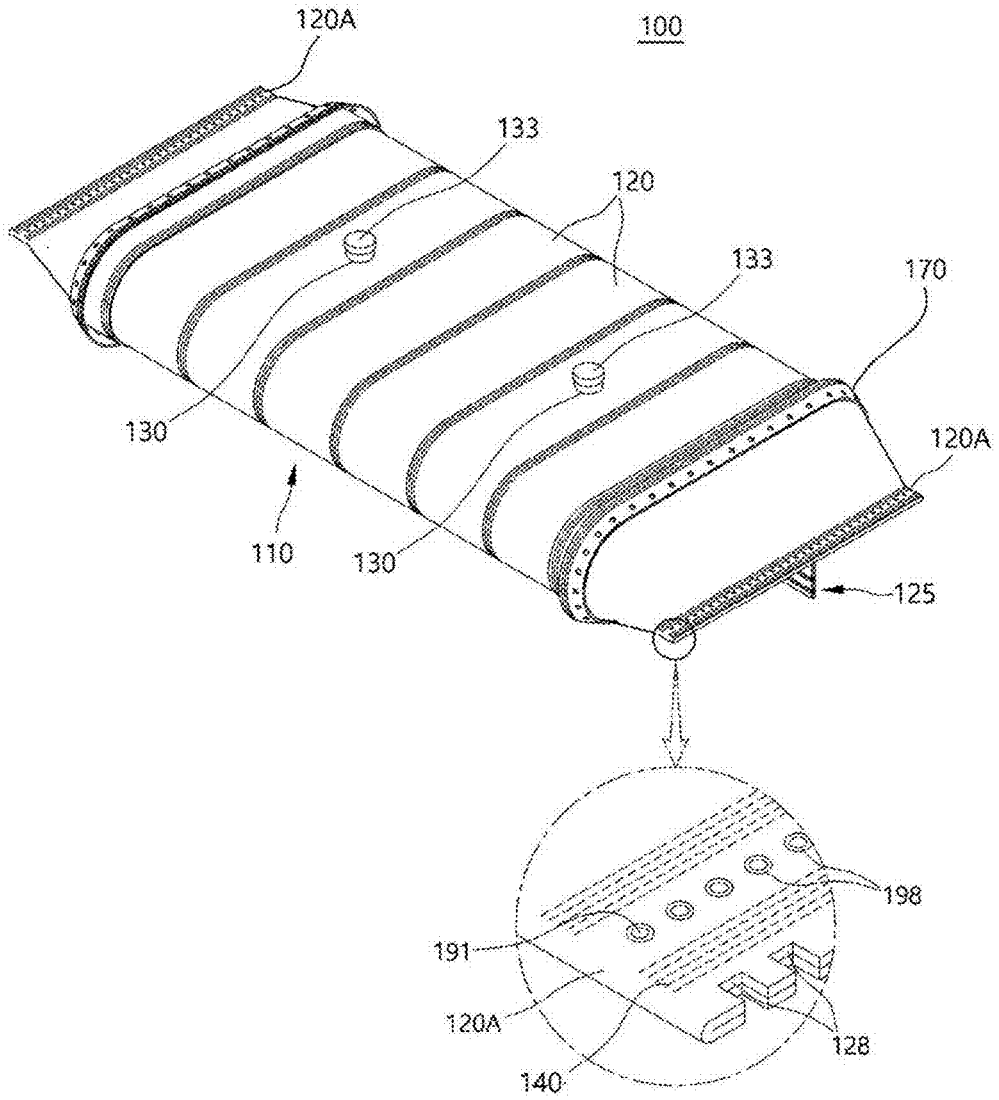
FIG. 6 is a perspective view showing the state in which the tube body part shown in FIG. 5 has been filled with dredged soil.

FIG. 3 is a view schematically showing an unfolded state of the tube body part in the civil engineering civil fiber tube structure according to an embodiment of the present disclosure, FIG. 4 is a perspective view showing a state in which a tube body part has been formed in a drum shape by coupling both ends of the tube body part shown in FIG. 3, FIG. 5 is a perspective view showing the state in which a first side and a second side of the tube body part shown in FIG. 4 have been closed, and FIG. 6 is a perspective view showing the state in which the tube structure shown in FIG. 5 has been filled with dredged soil.

As shown in FIGS. 3 to 5, a civil engineering civil fiber tube structure 100 according to an embodiment of the present disclosure includes a tube body part 110 and an injection tap 130.

The tube body part 110 is made of a flexible civil fiber material, initially has a rectangular shape, and is rolled in a drum shape such that a lower coupling portion 125 is formed at a lower center portion by coupling both ends in a longitudinal direction of the drum.

In this configuration, the tube body part 110 is formed by coupling a plurality of unit tube members 120A constituting the tube structure 100 and having a rectangular shape to adjacent unit tube members 120A in a longitudinal direction.

That is, a rectangular unit tube member 120*a* having a short side of 2*m* and a long side of 10*m* is coupled to unit tube members 120A adjacent to each other in the longitudinal direction of the tube structure 100 such that the long sides are coupled.

In this configuration, the unit tube members 120A are coupled by sewing thread 140 with first side and second side regions of adjacent unit tube members 120A partially overlapping each other.

A plurality of sewing threads 140 is applied at each of predetermined gaps in the longitudinal direction of the coupling portion and each portion of the sewing threads 140 may be overlapped two or more times.

Further, the tube body part 110 formed by combining the unit tube members 120A are bent substantially in a drum shape, and in this state, partial regions of both ends of the tube body part 110 form a bending margin portion 122, and sewing threads 140 are coupled with the bending margin portions 122 bent to protrude outward with the same length, whereby the lower coupling portion 125 is formed in the longitudinal direction of the tube structure 100.

Further, when the lower coupling portion 125 is positioned at the lower center portion of the tube structure 100, one or more injection taps 130 are applied through the inside and outside of the tube body part 110 in the longitudinal direction of the tube structure 100 over the lower coupling portion 125, that is, at the upper center portion of the tube body part 110, and a cap 133 for opening and closing the injection tap 130 is additionally provided.

The application structure of the injection tap 130 depends on various known techniques and is not described in detail.

Meanwhile, both open sides of the tube body part 110 are closed by sewing threads 140, whereby coupling portions 120A are formed.

As shown in the figures, sewing threads 140 are applied in a plurality of lines in a direction crossing the longitudinal direction of the tube body part 110 in predetermined regions at both ends of the tube body part 110, whereby the coupling portion 120A is formed in a band shape.

As shown in the figures, when dredged soil is injected into the tube body part 110 and the tube body part 110 expands, the coupling portion 120A protrudes in directions with heights corresponding to each other at both sides of the tube body part 110.

Further, first connection coupling holes 191 are provided at predetermined gaps at the coupling portion 120A in a direction crossing the longitudinal direction of the tube body part 110.

In this configuration, the first connection coupling hole 191 is formed in a ring shape, and as shown in the figures, a plurality of first connection coupling holes 191 is provided in one line with predetermined gaps in the longitudinal direction of the coupling portion 120A.

Further, it is preferable that a metallic reinforcing ring 198 is further installed around the first connection coupling hole 191 so that the durability around the first connection coupling hole 191 is increased when the coupling portions 120A of two tube structures 100 are connected using binding members such as a cable tie.

Meanwhile, it is preferable that sewing threads 140 are applied at both sides of the first connection coupling hole 191 at the coupling portion 120A in the longitudinal direction of the tube body part 110.

Further, according to this embodiment, gap grooves 128 are longitudinally applied at the end of the coupling portion 120A. The gap grooves 128 serves to enable dredged soil that is injected from above to be more smoothly moved under the coupling portion 120A through the gap grooves 128 when the coupling portion 120A of the tube body part 110 is coupled to the first connection coupling hole 191 using cable ties.

The gap grooves 128 may be applied in advance to the ends of the tube body part 110, or may be formed through additional cutting after the coupling portions 120A are formed.

Meanwhile, in the tube structure 100 according to this embodiment, a pair of assistant coupling members 170 is applied along the outer circumference at both sides of the tube body part 110 in a direction crossing the longitudinal direction of the tube body part 110.

Figure 7:
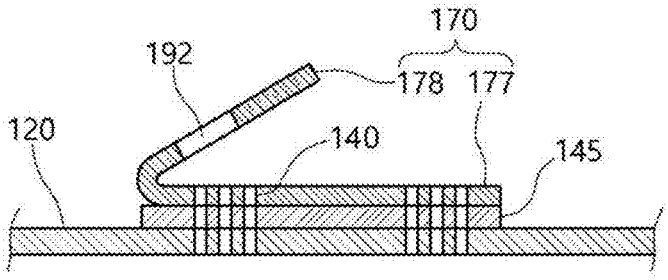
FIG. 7 is a cross-sectional view of main parts that shows the state in which an assistant coupling member has been installed on a tube body part.

FIG. 7 is an enlarged cross-sectional view showing the state in which an assistant coupling member has been applied to a civil engineering civil fiber tube structure according to an embodiment of the present disclosure. Referring to FIGS. 6 and 7, the assistant coupling member 170 has a band shape having a predetermined length and is coupled to the tube body part 110 by a sewing thread 140.

In this configuration, a band-shaped friction member 145 surrounding the tube body part 110 is applied between the tube body part 110 and the assistant coupling member 170 and is coupled together to the tube body part 1110 by a sewing thread 140. The friction member 145 serves to increase shear resistance force between the assistant coupling member 170 and the tube body part 110 when tension is applied to the assistant coupling member 170.

Further, the assistant coupling member 170 has a plurality of second connection coupling holes 192 in the longitudinal direction of the assistant coupling member 170. In this configuration, it is preferable that the second connection coupling hole 192 is also formed in a ring shape and a reinforcing ring (not shown) is applied around the second connection coupling hole 192.

Meanwhile, the assistant coupling member 170 has a generally folded shape and includes a first assistant coupling section 177 coupled to the tube body part 110 and a second assistant coupling section 178 having the second connection coupling holes 192.

In this configuration, the first assistant coupling section 177 and the second assistant coupling section 178 are formed in opposite directions in the tube body part 110.

Figure 8:
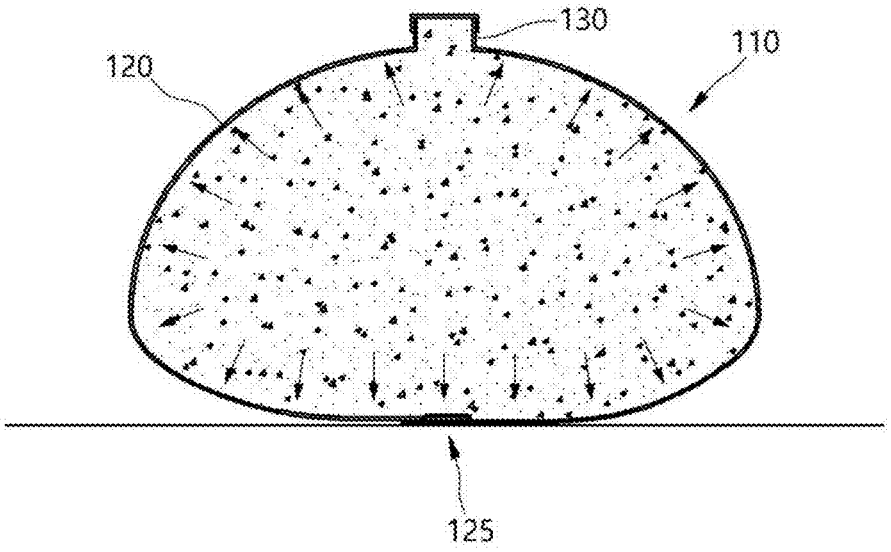
FIG. 8 is a view showing the state in which a tube structure according to an embodiment of the present disclosure has been filled with dredged soil.

FIG. 8 is a cross-sectional view schematically showing the state in which the tube structure according to the embodiments described above has been filled with dredged soil.

As shown in the figures, when a separate injection hose is connected to the injection tap 130 and dredged soil is fed into the tube structure 100, the lower coupling portion 125 that comes in contact with a marine ground is positioned at the center of the fully filled tube structure 100 and the tube body part 110 is pressed between the fed dredged soil and the marine ground, whereby a structure that is strong against shear force that is generated at both lower sides of the tube body part 110 when the tube body part 110 expands outward is formed, which results in an effect of increasing the coupling force of the lower coupling portion 125. Accordingly, the coupling state of the lower coupling portion 125 can be stably maintained even though a considerable amount of time passes.

Figure 9:
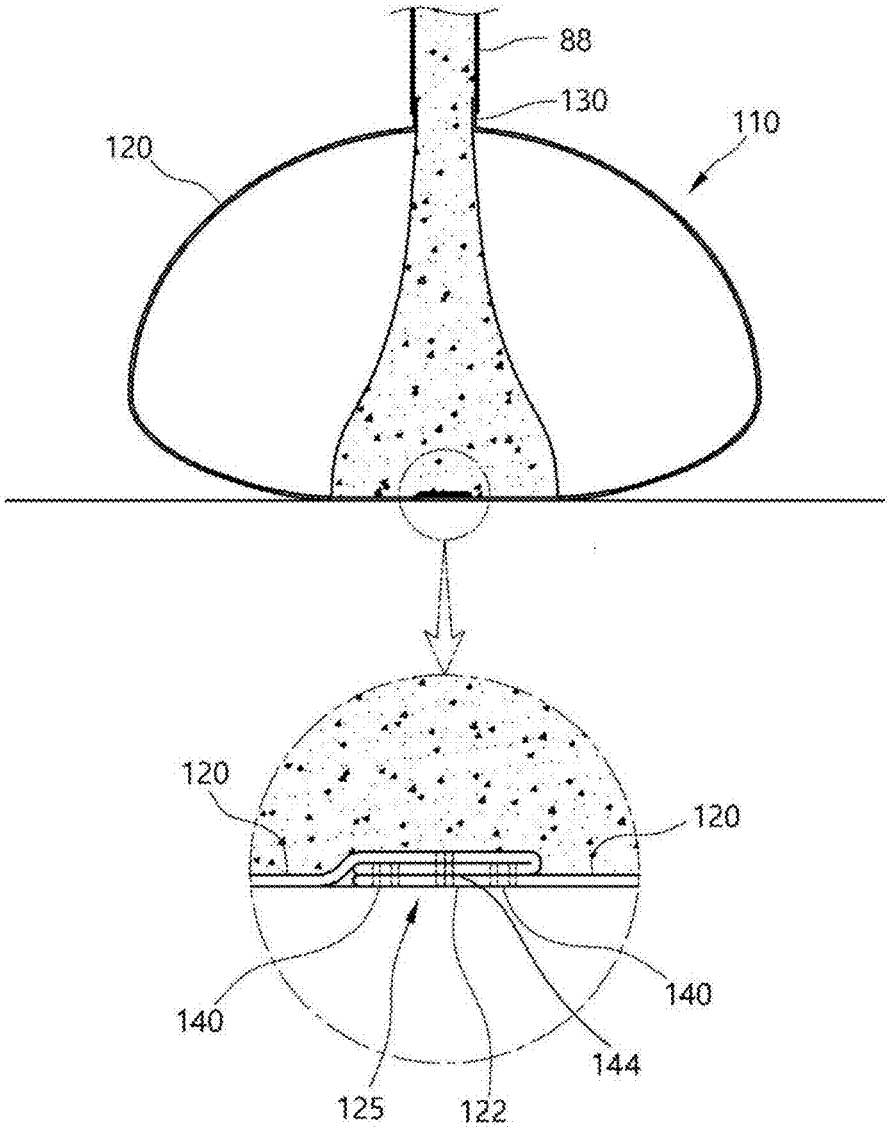
FIG. 9 is a view illustrating another type of coupling state of a lower coupling portion.

Meanwhile, FIG. 9 is a view illustrating another type of coupling state of a lower coupling portion. As described above, the lower coupling portion 125 is formed on the outer side of the tube body part 110 and then bent to be folded at a side on the outer side of the tube body part 110, and then the bottom of the tube body part 110 and the lower coupling portion 125 may be coupled using a separate sewing thread 144.

That is, when the lower coupling portion 125 is bent to be folded at a side on the outer surface of the tube body part 110 and then the bottom of the tube body part 110 and the lower coupling portion 125 are coupled using a separate sewing thread 144, double sewing threads 140 and 144 are applied and the position of the lower coupling portion 125 is stably fixed, whereby it is possible to more stably maintain the coupling state of the lower coupling portion 125 when installing the tube structure 100 on a marine ground.

Figure 10:
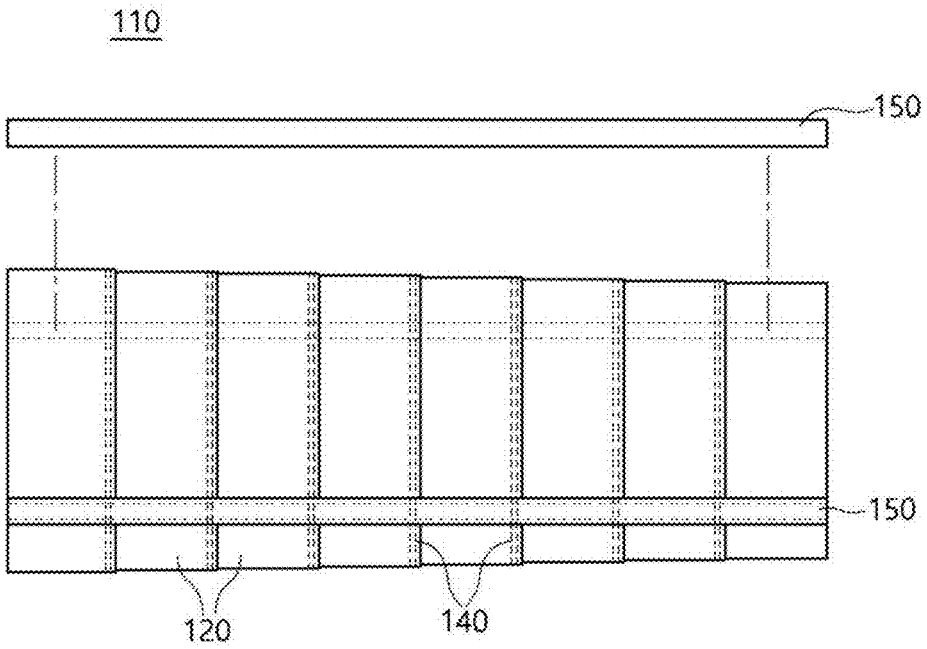
FIG. 10 is a plan view showing the state in which a reinforcing band member has been applied to a tube body part.
Figure 11:
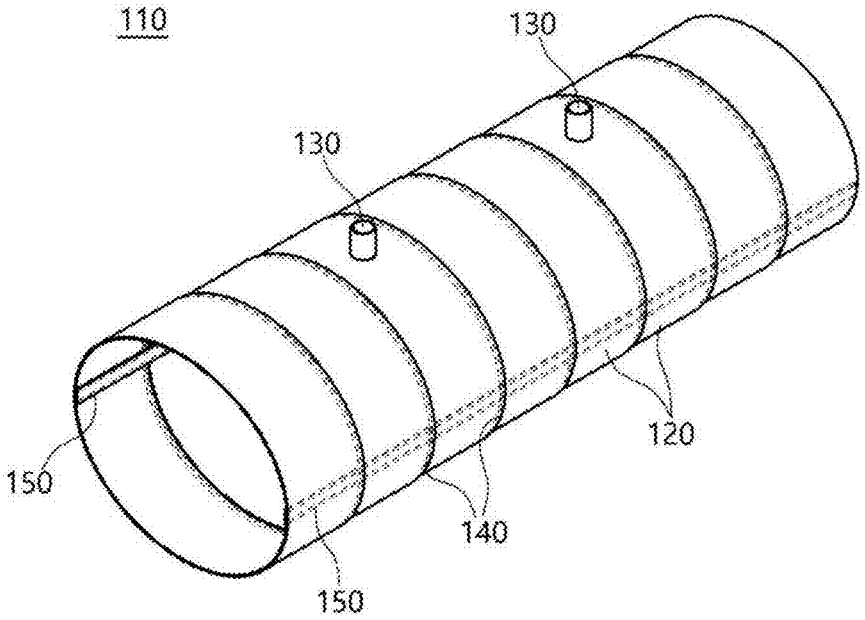
FIG. 11 is a perspective view showing the state in which a reinforcing band member has been applied to a tube body part formed in a drum shape.

FIG. 10 is a plan view showing the state in which a reinforcing band member has been applied to a tube body part and FIG. 11 is a perspective view showing the state in which a reinforcing band member has been applied to a tube body part formed in a drum shape.

As shown in the figures, a reinforcing band member 150 that is coupled to the tube body part 110 by a sewing thread 140 in the longitudinal direction of the tube structure that is constructed may be further provided.

The reinforcing band member 150 may also be made of a civil fiber and a plurality of reinforcing band members may be applied, and it is preferable that when the tube body part 110 is formed in a drum shape, the reinforcing band members are symmetrically applied at both sides in a cross-section.

The reinforcing band member 150 serves to reinforce the coupling state of the unit tube members 120A, and though not shown in detail, the reinforcing band member 150 induces an increase in shear force such that a friction member made of rubber or the like is additionally applied to the side being in surface contact with the tube body part 110, thereby being able to further reinforce the coupling state of the unit tube members 120A.

Similarly, a friction member made of rubber or the like may be applied to one unit tube member 120A at the overlapping portion of the unit tube members 120A.

Figure 12:
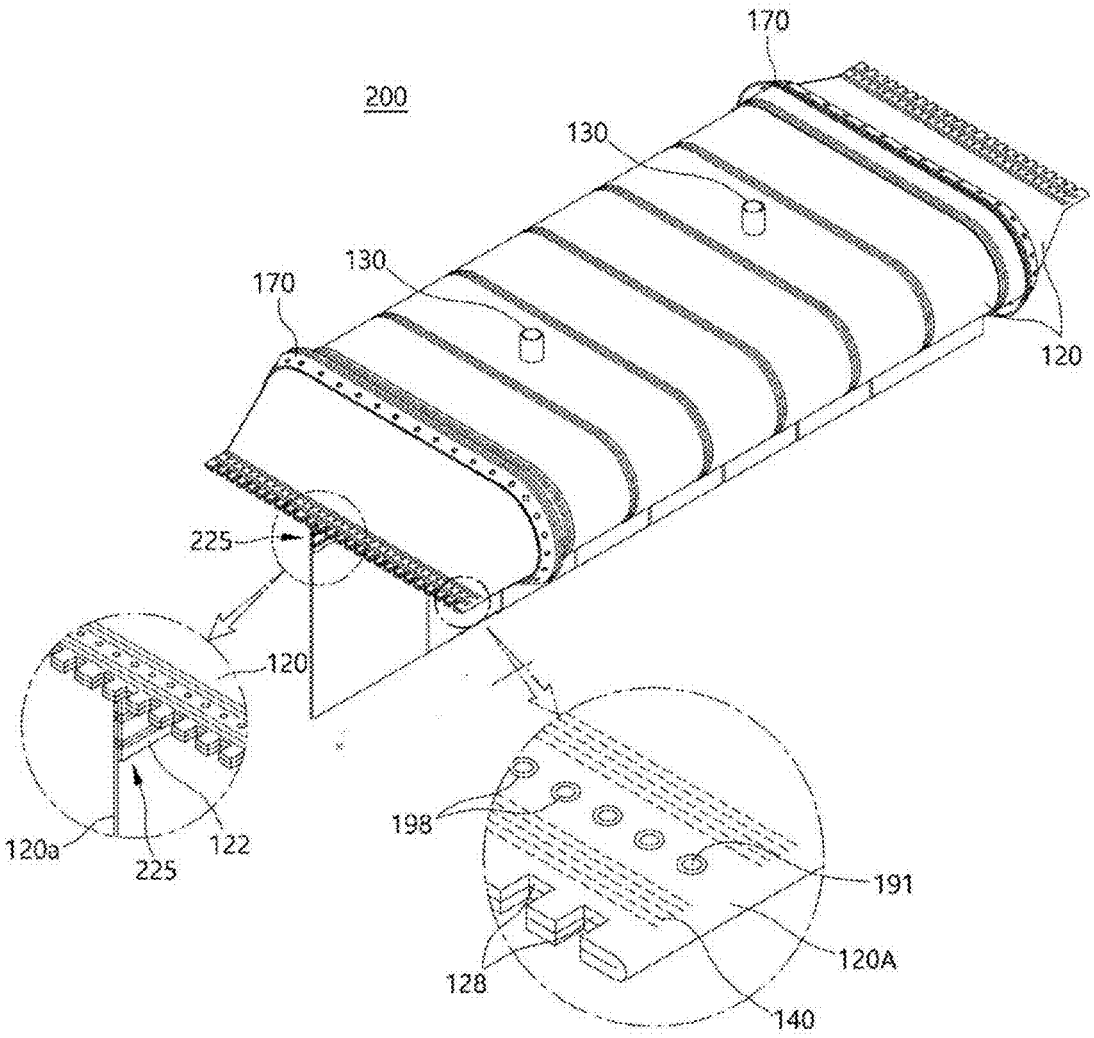
FIG. 12 is a perspective view showing a tube structure according to another embodiment of the present disclosure.
Figure 13:
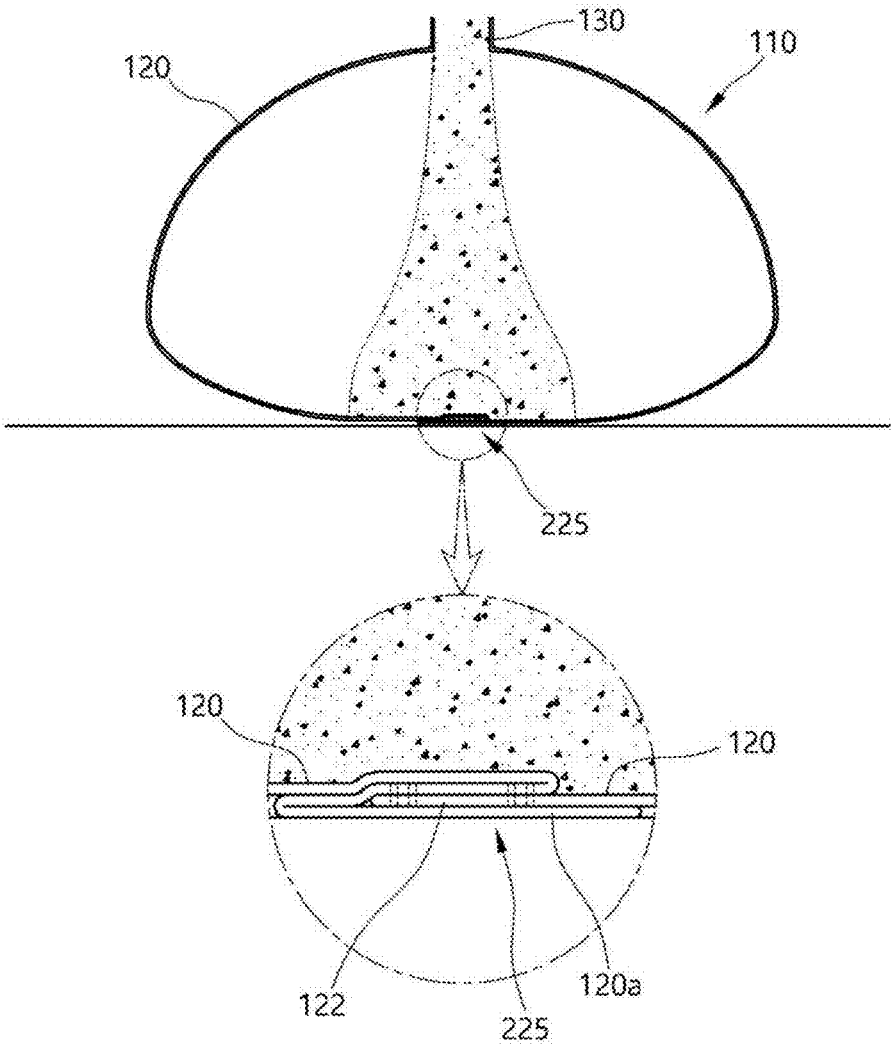
FIG. 13 is a cross-sectional view schematically showing the state in which dredged soil is injected after the tube body part shown in FIG. 12 is installed on a marine ground, etc.

FIG. 12 is a perspective view showing a tube structure according to another embodiment of the present disclosure and FIG. 13 is a cross-sectional view schematically showing the state in which dredged soil is injected after the tube body part shown in FIG. 12 is installed.

According to a tube structure 200 according to this embodiment, the tube body part 110 having a rectangular shape is bent such that the bending margin portion 122 described above is formed at a first end of the tube body part 110 and a bending long margin portion 120*a* longer than the bending margin portion 122 is formed at a second end of the tube body part 110 in the longitudinal direction of the tube structure in the process of bending the tube body part 110 in a drum shape.

Then, the bending margin portion 122 and the bending long margin portion 120*a* are coupled by a sewing thread such that the bending long margin portion 120*a* is partially exposed under the bending margin portion 122, whereby a second lower coupling portion 225 is formed.

When the tube structure to which the second lower coupling portion 225 is applied is installed on a marine ground, as in FIG. 13, the bending long margin portion 120*a* are bent twice, so the tube structure can be installed with the region of the second lower coupling portion 225 hidden from the outside.

Figure 14:
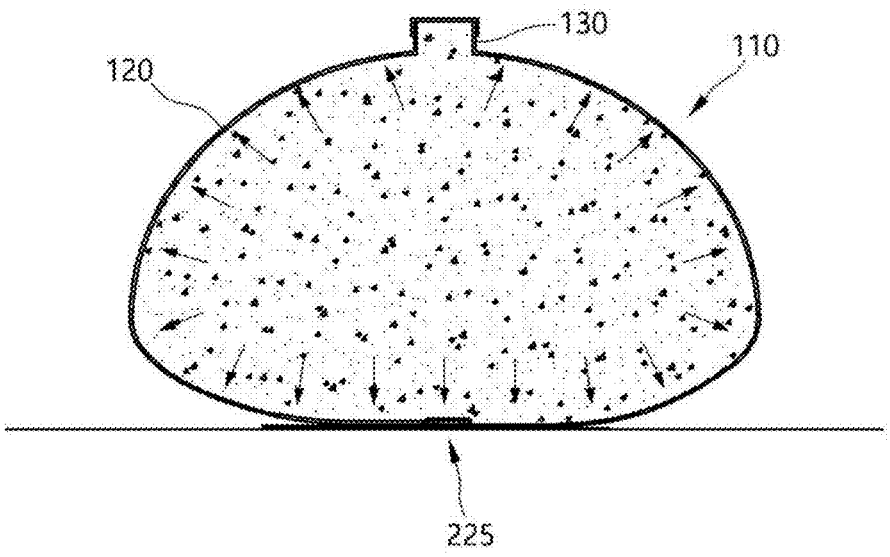
FIG. 14 is a view showing the state in which a tube structure according to another embodiment of the present disclosure has been filled with dredged soil.

Accordingly, there is no direct contact between the marine ground and the bottom of the tube body part 110, so, as in FIG. 14, when the tube body part 110 is fully filled with dredged soil, the durability of the lower coupling portion can be further increased in comparison to the tube structure according to the embodiment described above.

Meanwhile, in this case, the outer surface that comes in contact with a marine ground due to double bending of the bending long margin portion 120*a* is coated with rubber or the like so that durability that is stronger against an external environment. Further, as described above, the second lower coupling portion 225 may be coupled to the tube body part 110 in advance by a sewing thread in a bent state.

Figure 15:
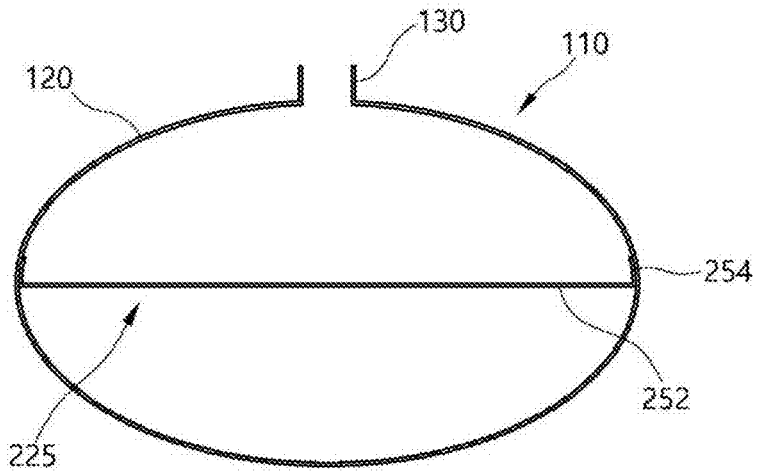
FIG. 15 is a view schematically showing a tube structure equipped with a transverse reinforcing member.
Figure 16:
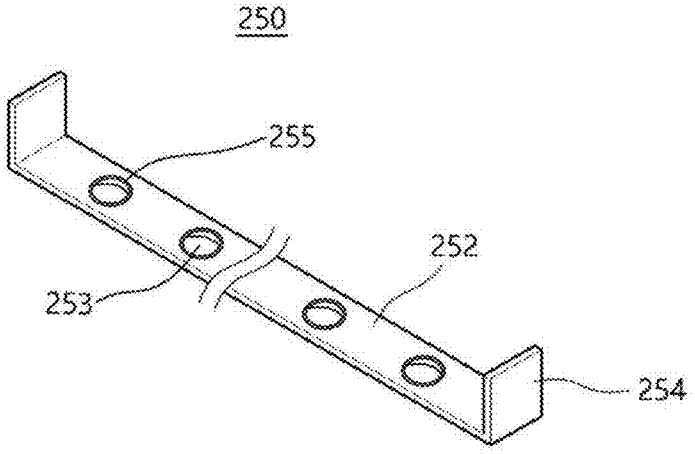
FIG. 16 is a perspective view of the transverse reinforcing member shown in FIG. 15.

FIG. 15 is a view schematically showing a tube structure equipped with a transverse reinforcing member and FIG. 16 is a perspective view of the transverse reinforcing member shown in FIG. 15.

In this embodiment, a transverse reinforcing member 250 crossing both sides of the tube body part 110 is applied in the tube body part 110 at each of preset gaps in the longitudinal direction of the tube structure.

The transverse reinforcing member 250 is made of a civil fiber and is composed of a pair of coupling portions 254 that are coupled by sewing threads and a bridge 252 connecting the coupling portions 254 inside the tube body 110.

In this configuration, through-holes 253 are formed with predetermined gaps in the longitudinal direction of the bridge 252 and it is preferable to apply a reinforcing ring 255 around the through-hole 253. The through-holes 253 serve to enable dredged soil to be smoothly fed even around the bridge 252 through the through-holes 253 when the tube body part 110 is filled with dredged soil.

When the transverse reinforcing member 250 is applied, it serves to support pressure due to dredged soil that is fed into the tube structure 100.

Figure 17:
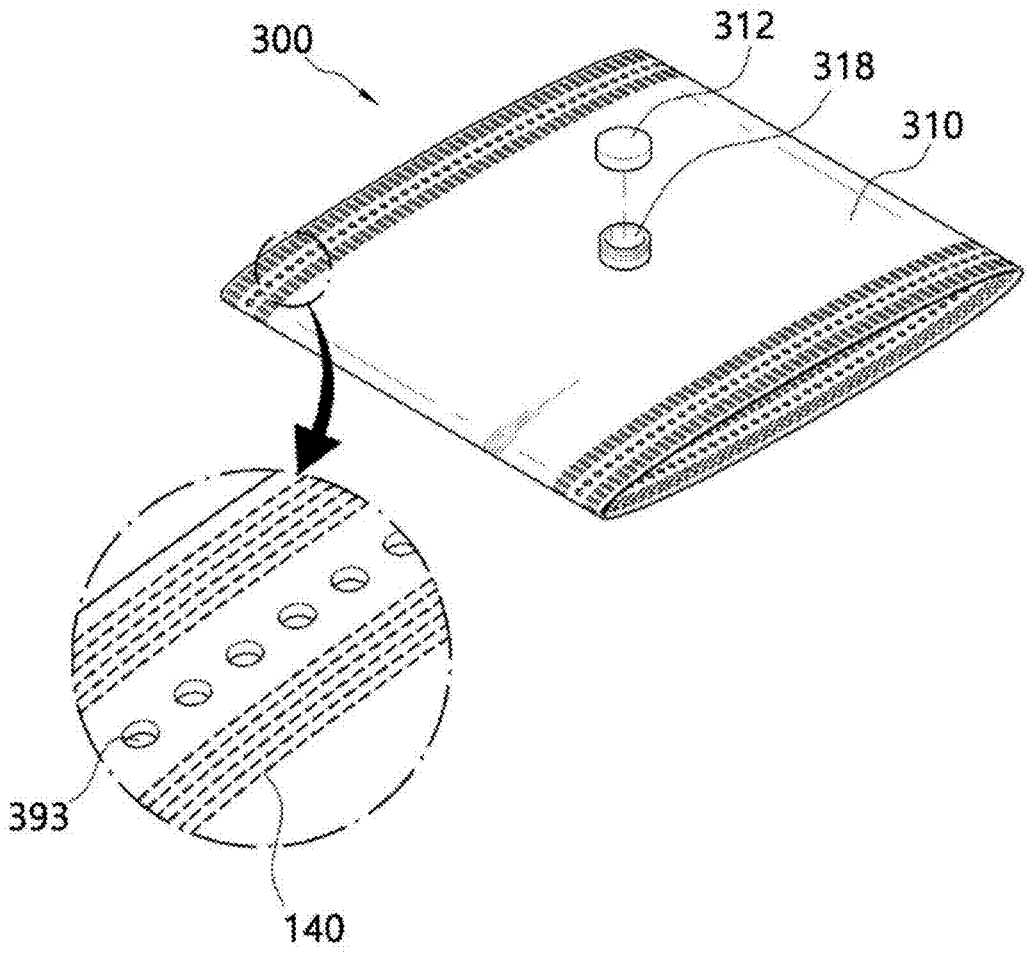
FIG. 17 is a perspective view showing the external appearance of an assistant tube member that is used to couple civil engineering civil fiber tube structures according to an embodiment of the present disclosure.

FIG. 17 is a perspective view showing the external appearance of an assistant tube member that is used to couple civil engineering civil fiber tube structures according to an embodiment of the present disclosure. The assistant tube member 300 includes an assistant body part 310 forming an external appearance, an assistant injection tap 318, and second connecting coupling holes 393.

The assistant body part 310 is formed to cover the outer side of the assistant coupling member 170 of the tube body part 110. In more detail, the assistant body part 310 is configured to cover the outer circumference of the assistant coupling member 170 in close contact with the outer side of the assistant coupling member 170. To this end, the assistant body part 310 is formed in drum shape with both open sides.

Further, the second connecting coupling holes 393 are formed at both sides of the assistant body part 310 at positions corresponding to the second connection coupling holes 192 of the assistant coupling members 170 installed on the tube structure 100.

Meanwhile, the assistant tube member 300 is also coupled by sewing thread 140 forming a plurality of lines as stitching threads at both sides of the second connecting coupling holes 393, whereby the durability thereof is increased.

Further, the assistant body part 310 has an assistant injection tap 318 so that dredged soil, etc. can be injected into the assistant body part 310.

The assistant injection tap 318 is also formed in an injection tube shape protruding outward and an assistant cap 312 that closes the assistant injection tap 318 by being coupled to the assistant injection tap 318 in a rotation type is further applied.

Meanwhile, when the coupling portions 120A of two tube structures are coupled at both sides of the assistant body part 310 of the assistant tube member 300, it is preferable that the first connection coupling holes 191 are positioned vertically under the assistant injection tap 318, which will be described in detail below.

Hereafter, a method of injecting dredged soil after a tube structure and an assistant tube member configured as described above are installed and combined.

Figure 18:
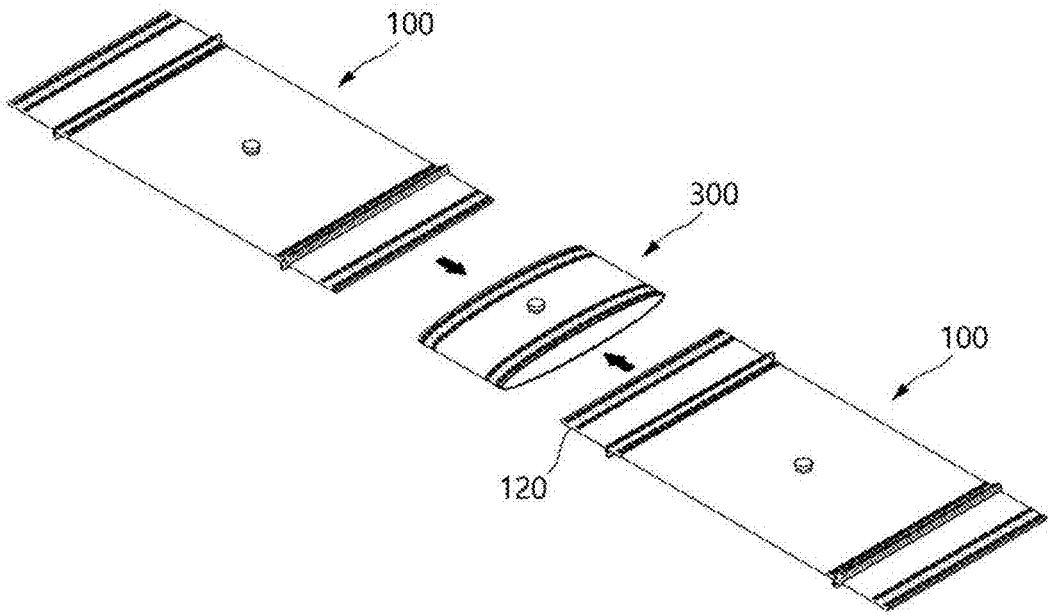
FIG. 18 is a perspective view showing the state before a tube structure and an assistant tube member according to an embodiment of the present disclosure are combined.

FIG. 18 is a perspective view showing the state before a tube structure and an assistant tube member according to an embodiment of the present disclosure are combined.

As shown in the figure, the tube structure 100 and the assistant tube member 300 are installed at a position where a seawall is constructed. In this case, two tube structures 100 are disposed at both sides of one assistant tube member 300.

Thereafter, the assistant tube member 300 is positioned to cover both of the first side and the second side of the pair of tube structures 100.

Next, a process of coupling the assistant tube member 300 to the assistant coupling member 170 of one tube structure 100 of the one pair of tube structures 100 disposed at both sides of the assistant tube member 300 is performed.

In this case, the third connection coupling holes 393 of the assistant tube member 300 are aligned with the second connection coupling holes 192 of the assistant coupling member 170 and then the second connection coupling holes 192 and the third connection coupling holes 393 are coupled using binding members such as a cable tie or a rope, whereby the first side of the assistant tube member 300 is coupled to the assistant coupling member 170.

Figure 19:
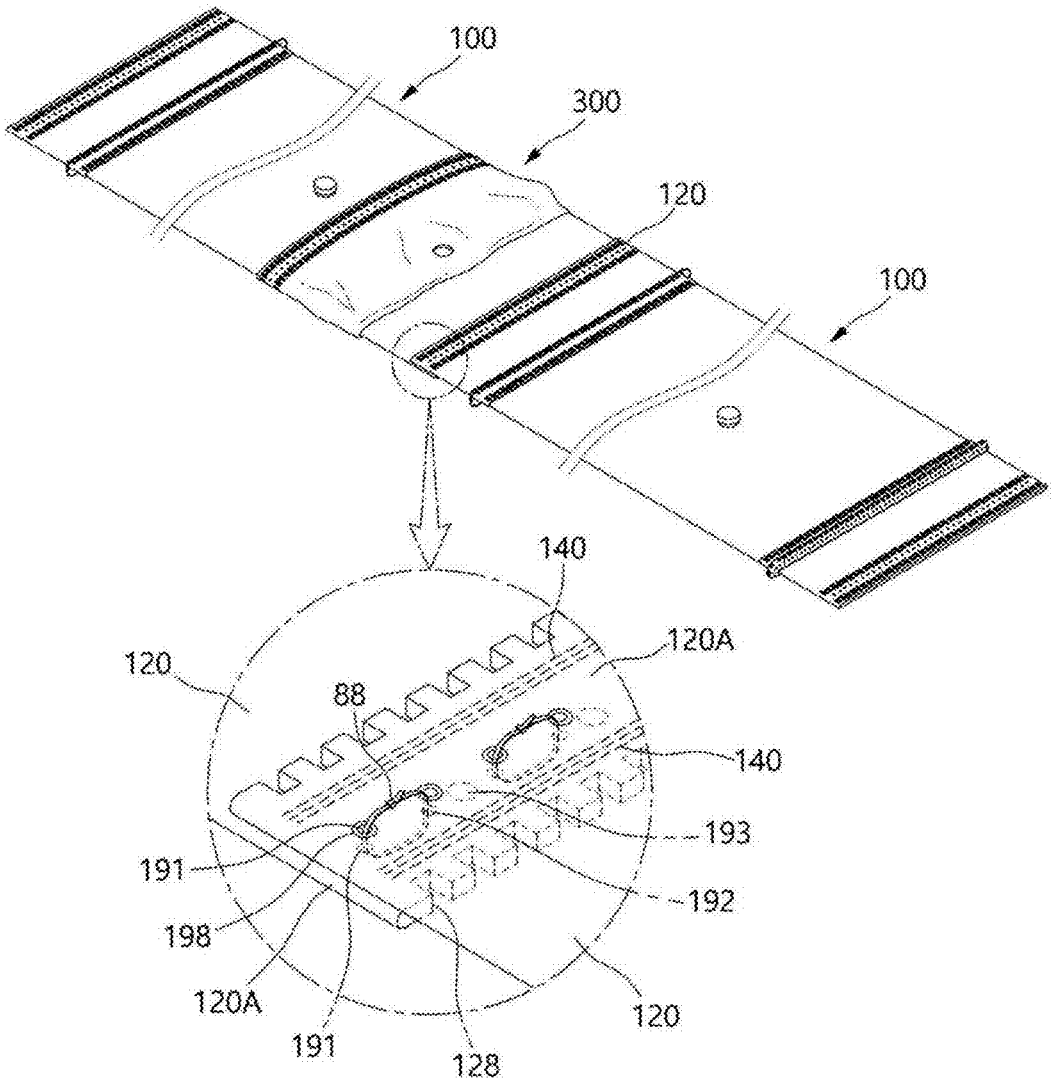
FIG. 19 is a perspective view schematically showing the state in which a tube structure and an assistant tube member are combined.

Next, as shown in FIG. 19, the second side portion of the assistant tube member 300 is partially folded outward and the coupling portions 120A of both tube structures 100 are disposed to overlap each other, and then they are coupled using binding members 88 such as a cable tie. That is, the coupling portions 120A of both tube structures 100 are disposed to be aligned with the first connection coupling holes 191 and then the coupling portions 120A of both tube structures 100 are coupled using predetermined binding members 88.

In this case, it is preferable that the diameter of the binding members 88 is considerably smaller than the diameter of the first connection coupling holes 191.

Further, when the coupling portions 120A of both tube structures 100 are coupled using predetermined binding members 88, one pair of bound coupling portions 120A can form a predetermined up-down gap.

Thereafter, the folded second side portion of the assistant tube member 300 is returned into the initial state to cover the first side of the other tube structure 100, and then, as described above, the third connection coupling holes 393 of the assistant tube member 300 are aligned with the second connection coupling holes 192 of the assistant coupling member 170 of the other tube structure 100, and then the second side of the assistant tube member 300 is coupled to the assistant coupling member 170 using binding members.

A seawall having a preset length is constructed by repeating the method of coupling the tube structure and the assistant tube member 300 many times.

Figure 20:
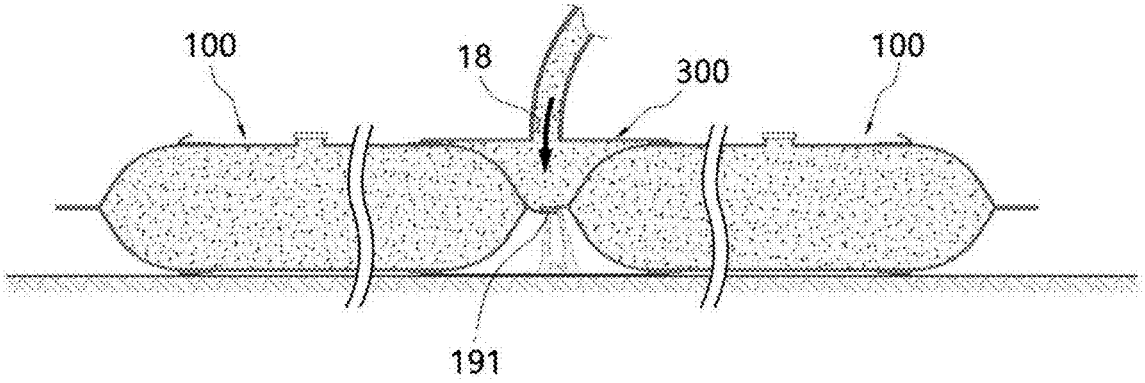
FIG. 20 is a view schematically showing the state in which dredged soil is injected with two tube structures and an assistant tube member completely combined.

FIG. 20 is a view schematically showing the state in which dredged soil is injected with two tube structures and an assistant tube member completely combined.

As shown in the figure, after the process of coupling the tube structure 100 and the assistant tube member 300 is finished, a process of expanding the body part 110 by injecting dredged soil using the injection tap 18 of the tube structure 100 is performed.

Thereafter, a dredged soil injection hose 18 is connected to the assistant injection tap 318 of the assistant tube member 300 and then dredged soil or the like is injected into the assistant tube member 300 such that the assistant tube member 300 is expanded.

In this case, the dredged soil is directly injected under the first connection coupling holes 191 positioned vertically under the assistant injection tap 318 of the assistant tube member 300, and dredged soil can be injected more fast through between the coupling portions 120A connected to each other at a predetermined distance from the first connection coupling holes 191.

Figure 21:
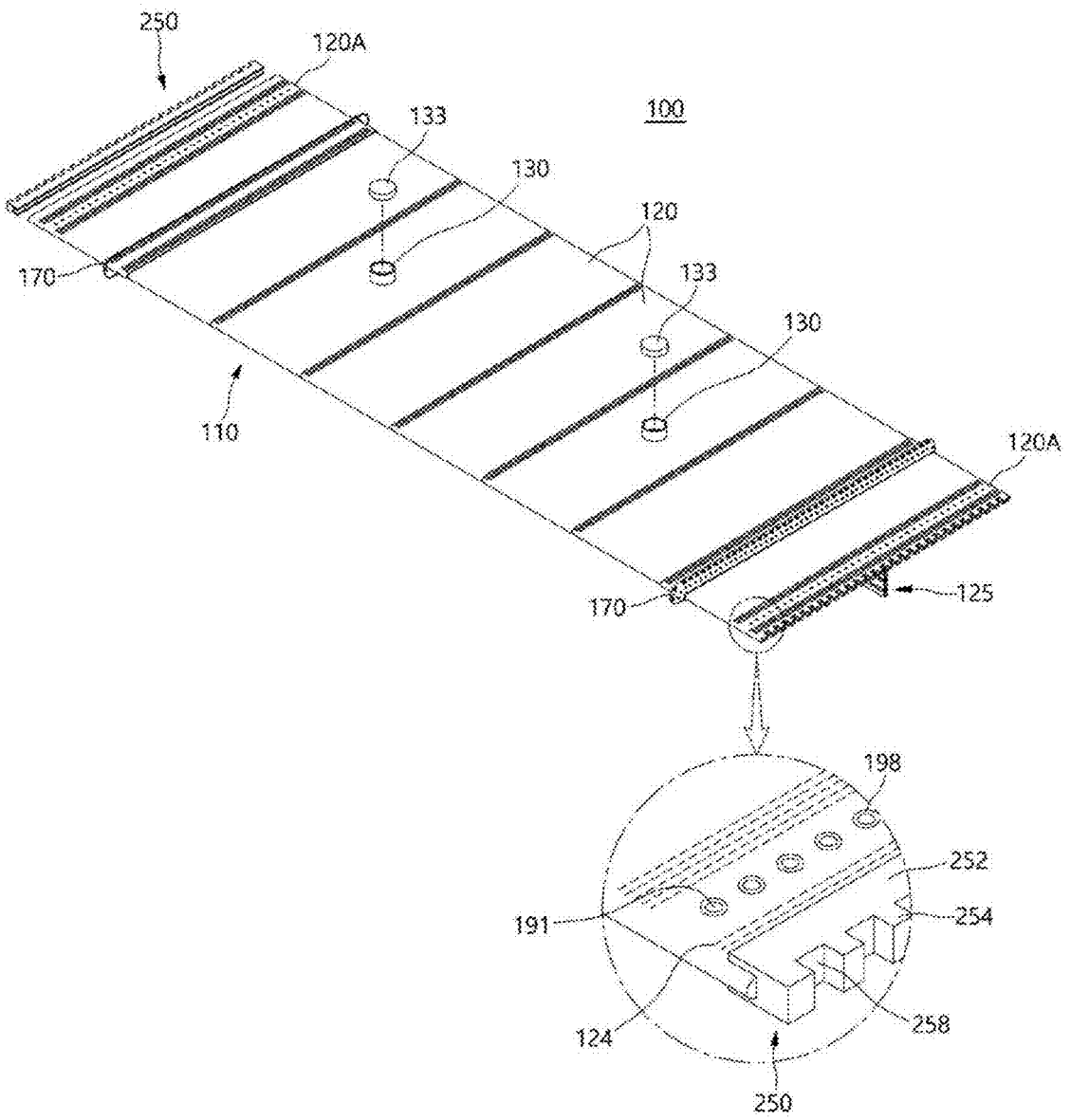
FIG. 21 is a perspective view showing a tube structure to which another type of end gap structure has been applied.

FIG. 21 is a perspective view showing a tube structure to which another type of end gap structure has been applied.

The tube structure 100 according to this embodiment also has a coupling portion 120A at both sides of the tube body part 110, and first connection coupling holes 191 are formed with predetermined gaps at the coupling portion 120A in a direction crossing the longitudinal direction of the body part 110.

Further, a metal reinforcing ring 198 is further provided around the first connection coupling hole 191, which is the same as the embodiments described above.

Meanwhile, in this embodiment, an end reinforcement unit 250 having gap grooves 258 formed in a longitudinal direction is installed in a pressed type at the end of the coupling portion 120A.

The end reinforcement unit 250 is composed of an end reinforcement clip 252 made of a metallic material and having a fitting portion at a first side, and protrusions 254 protruding with preset gaps at a second side of the end reinforcement clip 252, in which the gap groove 258 is formed between the protrusions 254.

In this embodiment, it is possible to increase durability at the end of the coupling portion 120A and it is possible to more smoothly inject dredged soil under the coupling portion 120A through the end gap groove 258 of the coupling portion 120A when injecting dredged soil into the assistant tube member 300 after coupling the coupling portion 120A of the tube body part 110 to the first connection coupling holes 191 using binding members.

Those skilled in the art could understand that an embodiment of the present disclosure can be achieved in other detailed ways without changing the spirit or the necessary features of the present disclosure. Therefore, the embodiments described above are only examples and should not be construed as being limitative in all respects. The scope of an embodiment of the present disclosure is defined by the following claims rather than the above detailed description, and all of changes and modifications obtained from the meaning and range of claims and equivalent concepts should be construed as being included in the scope of an embodiment of the present disclosure.

What is claimed is:

1. A civil engineering civil fiber tube structure comprising:

a tube body part made of a flexible civil fiber material, initially having a rectangular shape, and is rolled in a drum shape such that a lower coupling portion is formed at a lower center portion by coupling both ends in a longitudinal direction of the tube body part; and one or more injection taps disposed on a top in the longitudinal direction of the tube body part when the lower coupling portion is disposed at a lower center, wherein both open sides of the tube body part are closed by sewing threads, whereby coupling portions crossing the longitudinal direction of the tube body part are formed, and wherein first connection coupling holes are formed with predetermined gaps in the longitudinal direction of the coupling portion, wherein gap grooves are disposed with preset gaps in a longitudinal direction at an end of the coupling portion.

2. The civil engineering civil fiber tube structure of claim 1, wherein the lower coupling portion is formed such that bending margin portions are formed by bending preset regions, which are in contact with each other of both ends of the tube body part when the tube body part is bent in a drum shape from an initial state, to overlap each other, and the bending margin portions are coupled by sewing threads in the longitudinal direction of the tube structure.

3. The civil engineering civil fiber tube structure of claim 1, wherein the tube body part is formed by coupling ends of adjacent unit tube members of a plurality of rectangular unit tube members in the longitudinal direction.

4. The civil engineering civil fiber tube structure of claim 3, wherein the lower coupling portion is formed by forming bending margin portions protruding outward with the same length in the longitudinal direction of the tube body part at partial regions of both ends of the tube body part and then coupling the bending margin portions with a sewing thread in an overlap state.

5. The civil engineering civil fiber tube structure of claim 1, further comprising a pair of assistant coupling members disposed around an outer surface at both sides of the tube body part in a direction crossing the longitudinal direction of the tube body part, wherein second connection coupling holes are formed with predetermined gaps in a longitudinal direction of the assistant coupling member.

6. The civil engineering civil fiber tube structure of claim 1, further comprising a reinforcing band member coupled to the tube body part by a sewing thread in the longitudinal direction of the tube body part.

7. The civil engineering civil fiber tube structure of claim 1, further comprising a transverse reinforcing member disposed in the tube body part across an inside of the tube body part in a direction crossing the longitudinal direction of the tube body part with both ends coupled to an inner side of the tube body part when the tube body part is formed in a drum shape.

8. The civil engineering civil fiber tube structure of claim 7, wherein the transverse reinforcing member comprises a bridge disposed in the tube body part across the inside of the tube body part, and through-holes are disposed with predetermined gaps on the bridge.

9. The civil engineering civil fiber tube structure of claim 1, further comprising:

an assistant body part being open on both sides to be able to cover an outer side of the body part when the body part of the tube structure expands, and has a drum shape when expanding; and an assistant tube member including a plurality of third connection coupling holes disposed around the assistant body part at both sides of the assistant body part and an assistant injection tap provided so that dredged soil can be injected into the assistant body part.

10. A civil engineering civil fiber tube structure comprising:

a tube body part made of a flexible civil fiber material, initially having a rectangular shape, and is rolled in a drum shape such that a lower coupling portion is formed at a lower center portion by coupling both ends in a longitudinal direction of the tube body part;

one or more injection taps disposed on a top in the longitudinal direction of the tube body part when the lower coupling portion is disposed at a lower center; and a transverse reinforcing member disposed in the tube body part across an inside of the tube body part in a direction crossing the longitudinal direction of the tube body part with both ends coupled to an inner side of the tube body part when the tube body part is formed in a drum shape, wherein the transverse reinforcing member comprises a bridge disposed in the tube body part across the inside of the tube body part, and through-holes are disposed with predetermined gaps on the bridge, wherein both open sides of the tube body part are closed by sewing threads, whereby coupling portions crossing the longitudinal direction of the tube body part are formed, wherein first connection coupling holes are formed with predetermined gaps in the longitudinal direction of the coupling portion.

11. A civil engineering civil fiber tube structure comprising:

a tube body part made of a flexible civil fiber material, initially having a rectangular shape, and is rolled in a drum shape such that a lower coupling portion is formed at a lower center portion by coupling both ends in a longitudinal direction of the tube body part; and one or more injection taps disposed on a top in the longitudinal direction of the tube body part when the lower coupling portion is disposed at a lower center, wherein both open sides of the tube body part are closed by sewing threads, whereby coupling portions crossing the longitudinal direction of the tube body part are formed, wherein first connection coupling holes are formed with predetermined gaps in the longitudinal direction of the coupling portion, wherein an end reinforcement unit having gap grooves formed with preset gaps in a longitudinal direction is installed in a pressed type at an end of the coupling portion.

12. The civil engineering civil fiber tube structure of claim 11, wherein the end reinforcement unit includes:

an end reinforcement clip made of a metallic material and having a fitting portion formed at a first side to be pressed and fixed while covering an end of the coupling portion; and protrusions protruding with preset gaps at a second side of the end reinforcement clip, wherein gap grooves are formed between the protrusions.

* * * * *